United States Patent [19]

Van Cleave

[11] 4,291,845

[45] Sep. 29, 1981

[54] COIL CRADLE

[75] Inventor: Eugene H. Van Cleave, Orchard Lake, Mich.

[73] Assignee: Van Mark Products Corporation, Farmington Hills, Mich.

[21] Appl. No.: 134,510

[22] Filed: Mar. 27, 1980

[51] Int. Cl.[3] ..... B21C 47/16

[52] U.S. Cl. ..... 242/78.7

[58] Field of Search ..... 242/78.7, 78.6, 78.8, 242/68.7, 66

[56] References Cited

U.S. PATENT DOCUMENTS

| | | | |
|---|---|---|---|
| 2,345,373 | 3/1944 | Ayers | 242/78.7 |
| 3,154,263 | 10/1964 | Fischer | 242/78.7 |
| 3,408,020 | 10/1968 | Scott | 242/78.7 |

FOREIGN PATENT DOCUMENTS

| | | | |
|---|---|---|---|
| 447018 | 5/1936 | United Kingdom | 242/78.8 |

*Primary Examiner*—Edward J. McCarthy
*Attorney, Agent, or Firm*—H. P. Settle

[57] ABSTRACT

A holding device or "cradle" for holding a coil of sheet material so that the material can be unrolled from the coil and cut to length. The cradle takes the form of an open-topped tray having side walls and an end wall, the side walls supporting two horizontally disposed rollers upon which the coil is super-imposed. A third roller projects through the annular coil and is spring biased into contact with the interior of the coil to retain the coil in position. The unrolled sheet material is guided by the curved bottom onto a scoring or cutting bed which has spaced, parallel non-marring surfaces which are raised above the surface of the bed to define a cutting space therebetween. An upper score guide is moveable away from the scoring bed to accommodate the entry of sheet material therebetween and is moveable downwardly into contact with the sheet material to clamp the sheet material in position for cutting and to provide an elongated cutting edge which is aligned with the space between the non-marring surfaces. Further, the curved tray bottom is provided in a novel manner by compressing a planar metal sheet, in effect, between the tray side walls and the scoring bed.

9 Claims, 3 Drawing Figures

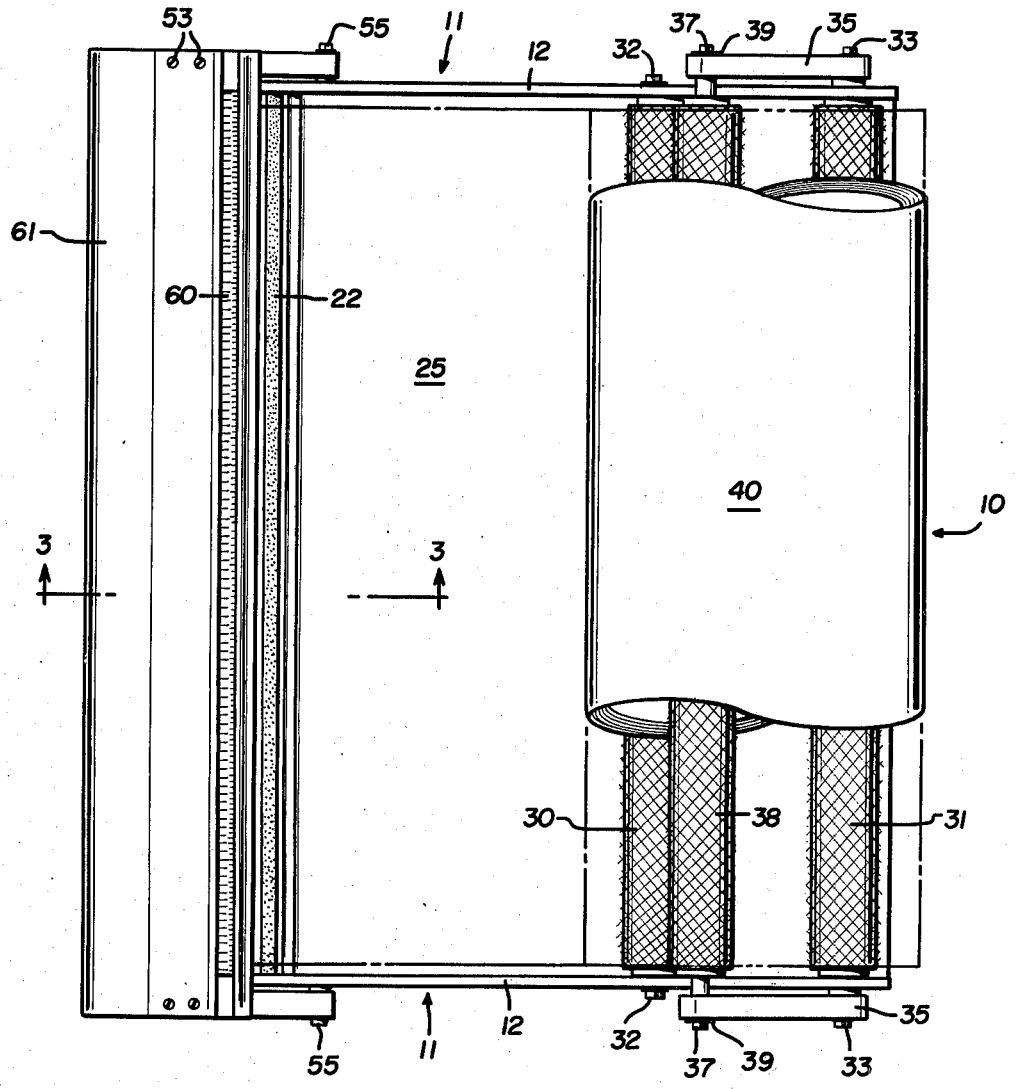
FIG. 1
FIG. 2
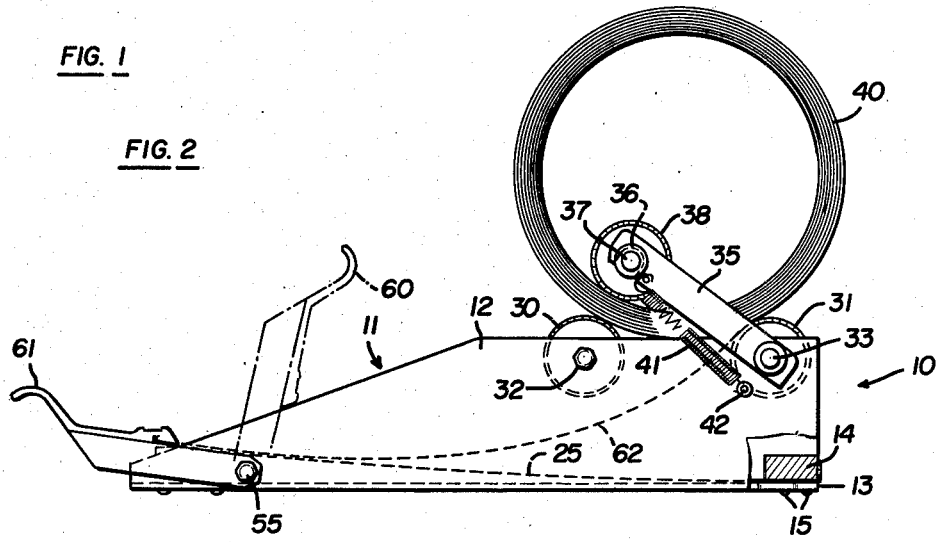

COIL CRADLE

BACKGROUND OF THE INVENTION

Coil cradles are devices for holding coils of sheet material, such as aluminum siding stock, in place so that the material can be unrolled from the coil and cut to length prior to installation or prior to another forming operation. Since such cradles are intended for on-site use, they must be light and easily portable, the coil stock must be held securely, yet be easily removeable, and the stock must not be marred. To facilitate the cutting of the coil, the unrolled sheet should be guided to a cutting location where the cutting can be accomplished while the stock is firmly retained in position, yet without marring the stock. The cutting is normally carried out by use of a cutting knife which is simply drawn across the material after it has been uncoiled.

Prior cradles which have been used in the prior art were simply open-topped and open-bottomed rectangular frames in which the coil is supported either interiorly or exteriorly by support rolls. In one prior art device, the coil was supported on a pair of lower support rolls and a third hold-down roll centered between the support rolls. The third roll was positioned interiorly of the coil and was retained in place by coiled screen door springs which were looped over the ends of the roll. In the prior art, the sheet was not guided to the cutting location, and thus required careful manual location. Further, the sheet was merely cut against a fixed portion of the frame as it was clamped beneath a pivoted hold-down element. There was no protection of the sheet against marring during positioning or cutting, and no special provision was made for any cutting area or surface, the cutter knife being simply drawn across the coiled portion of the coil.

BRIEF DESCRIPTION OF THE INVENTION

The coil cradle of the present invention provides an improved, lightweight device for retaining a coil in position where it can be readily uncoiled and cut to a desired length. Further, the device retains the coil positively in position, yet the coil is readily installed on and removed from its retained position. Additionally, non-marring surfaces are provided for both coil retention and for sheet metal severing.

More specifically, the present invention includes an open-topped frame having two transverse support rolls upon which the coil is superimposed, and a third roll projecting through the center of the coil. The third roll is supported in direct opposition to one of the support rolls and is carried on a pair of pivot arms which are easily attachable and detachable from the roll and which are spring urged to bias the third roll into contact with the coil, thus retaining the coil without any distorting force on the coil.

A curved tray bottom is provided which serves to guide the material from the coil directly to a clamping and severing section, the bottom wall being retained under compression in its curved configuration. The severing mechanism includes an upper, pivoted scoring guide which can be elevated to accommodate the entry of the sheet from the coil over a scoring bed of the tray, this clamping member being moveable downwardly to retain the sheet for severing against the scoring bed. The bed is provided with two spaced non-marring surfaces having a recess therebetween to accommodate the point of a severing tool which is simply moved along a guide edge of the scoring guide to sever sheet material from the material of the coil.

ON THE DRAWINGS

FIG. 1 is an elevational plan view of a coil cradle of the present invention;

FIG. 2 is the side elevational view of the coil cradle of FIG. 1; and

DESCRIPTION OF THE PREFERRED EMBODIMENT

Figure 3:
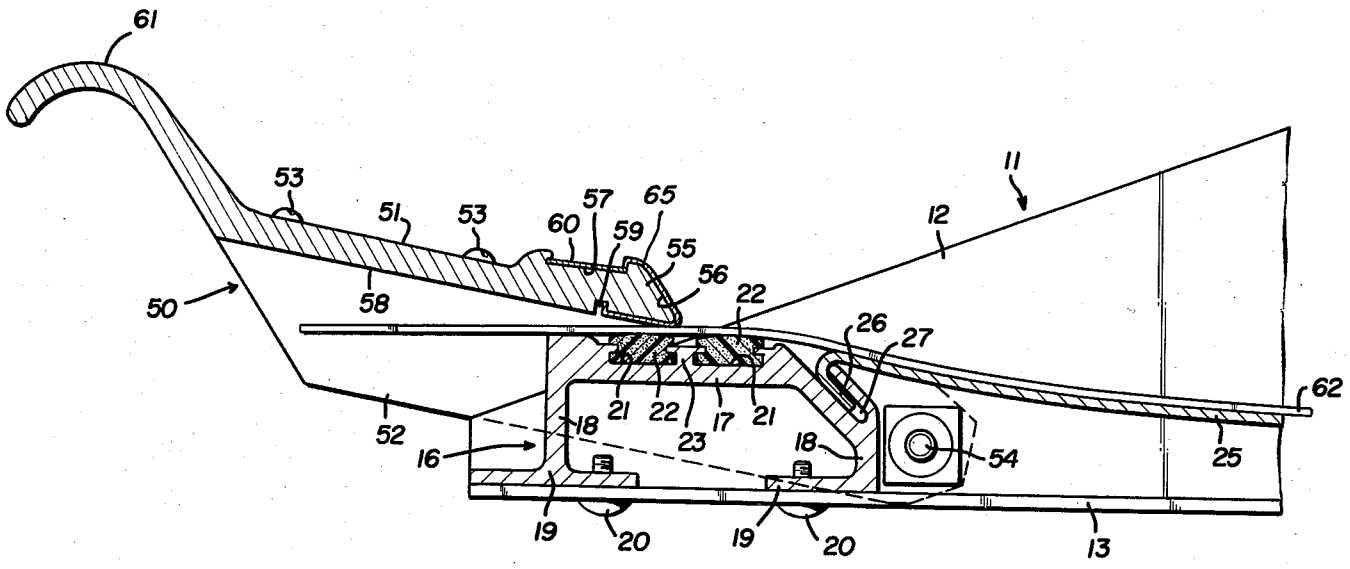
FIG. 3 is an enlarged sectional view, with parts shown in elevation, taken the plane 3—3 of FIG. 1.

As shown on the drawings, reference numeral 10 refers generally to a coil cradle of the present invention. The cradle comprises a pair of side plates 11 each of which includes a planar, vertically oriented side wall 12 and a lower, inturned bottom wall or flange 13. The lower flanges 13 of the side walls are joined by a rear wall 14 of rectangular configuration and secured to the flanges 13 by suitable means, as by screws or the like 15. The other extremities of the side plates 11 are joined by a front wall structure or scoring bed indicated generally at 16. The bed 16 is generally rectangular in exterior outline, is preferrably formed as an aluminum extrusion, and bridges the transversely spaced side plates 12. Thus, the side plates 12, the rear wall 14 and the bed 16 form a rectangular tray which is open-topped and open-bottomed.

As best illustrated in FIG. 3, the bed 16 has an upper portion 17 joined by legs 18 to lower horizontal portions 19 which are secured by suitable means, as by screws 20, to the flanges 13 of the side plates 12. The upper surface of the top portion 17 has a pair of reentrant recesses 21 therein extending across the entire length of the top portion 17 and adapted to receive therein anti-marring strips 22 preferrably formed of resilient elastomeric material, such as polyvinyl chloride. The strips 22 are spaced from one another by a central web portion 23 of the bed 16 which is recessed below the upper surfaces of the strips 22, for a purpose to be hereinafter more fully described.

A bottom wall 25 extends from the rear wall 14 to the scoring bed 16. This bottom wall 25 has its rear end interposed between the flanges 13 of the side plates 11 and the rear wall 14 and is secured in position by the fasteners 15. The free front edge of this bottom wall 25 has a downturned flange 26 which is received within a recess 27 formed in the scoring bed 16 adjacent the strips 22. The bottom wall 25 is of a length somewhat longer than the planar distance between its point of attachment to the rear wall 14 and its point of attachment to the bed 16, so that the bottom plate 25, when installed, is placed under compression and assumes the curved configuration illustrated in FIGS. 2 and 3.

Carried by the side plates 11 are a pair of longitudinally spaced, parallel, horizontal, freely rotatable support rollers 30, 31. The forward one of these rollers 30 is provided with a pair of stub shafts 32 projecting through the side 32 to support the roller for rotation about a horizontal axis. The rearward roller 31 has an extended cylindrical shaft 33 which projects through and laterally beyond the confines of the two side walls 12. The extended ends of the shaft 33 of the roller 31 carry a pair of pivot arms 35, each arm having one end freely rotatable on the shaft 33 and each arm having, adjacent its other free end, an open bottomed notch 36 receiving therein the adjacent end of the shaft 37 of a retaining roll 38. This retaining roll 38 projects through the axial opening of an annular coil 40 of sheet material superimposed on the lower support rolls 30, 31. The shaft 37 is provided, at each end, with an annular, centrally recessed spool 39 which supports the roll 38 for free rotation relative to the adjacent arm 35. A coil tension spring 41 interconnects each arm 35 adjacent its free end and an anchor pin 42 fixed to the side wall 12 beneath the arm 35. The rolls 30, 31, 38 are each covered with an open mesh sleeve of nylon or the like to provide non-marring coil-contacting surfaces.

A pivoted score guide, indicated generally at 50, is located adjacent the scoring bed 16 of the coil cradle. This score guide 50 comprises a guide body 51 preferably formed as an aluminum extrusion and having a pivot arm 52 fixedly secured to each end thereof by suitable means, as by screws 53. The pivot arms 52 project toward the coil 40 and are secured to the side walls 12 on pivot pins 55 so that the score guide is pivotal towards and away from the scoring bed, as best shown in FIG. 2.

The score guide body 51 is provided with a forward guide extension 55 provided with a sloping upper wall 56 immediately adjacent a recess 57 in the upper surface of the score guide. The horizontal undersurface 58 of the score guide is provided with a longitudinal notch 59. A scoring guide cover plate 65, formed of an abrasion resistant material, such as stainless steel, envelopes the nose of the scoring guide and has its terminal ends trapped in the notches 57, 59. A graduated scale 60 is positioned in the recess 57. An actuating handle 61 of curved configuration is provided at that end of the scoring guide remote from the front edge thereof.

The manner of utilization of the coil cradle will be apparent from the foregoing description and from the drawings. In use, the center roll 38 is removed from the arms 35 by simply elevating the arms, a coil 40 is superimposed on the support rolls 30, 31, the upper roll 38 is threaded through the center of the coil 40, and the arms 35 are re-engaged with the spools 39 to locate it on the roll shafts 37. The springs 41 then urge the upper roll 38 downwardly against the inner periphery of the roll 40 by the springs 41 acting on the arms 35, and no distorting force is exerted upon the coil. The coil 40 can be removed by simply elevating the arms, removing the spools 39 from the arm notches 36 against the bias of the springs 41, and then lifting the coil 40 from the rolls 30, 31.

Sheet material is uncoiled from the coil 40 between the rolls 30, 31 as illustrated in FIG. 2 at 62. The uncoiled material 62 is guided by the bottom wall 25 onto the upper surface of the scoring bed 16, and the uncoiled stock contacts only the non-marring inserts 22, as best shown in FIG. 3 of the drawings. After the desired amount of sheet stock has been removed from the coil 40, the scoring guide 50 is lowered, by pivoting the arm about the pivot pins 54, to its position shown in FIG. 3 of the drawings. It will be noted that the nose of the scoring guide 50, defined by the lower edge of the inclined wall 56 thereof and the cover plate thereon, is directly aligned with the recess 23 defined between the two inserts 22. A cutting knife is then drawn along the nose of the scoring guide to score and/or sever the sheet stock transversely. The knife need not contact the scoring bed, and the cap protects the nose of the score guide.

I claim:

1. A coil cradle for a coil of sheet material comprising an open-topped tray having side walls, a pair of support rollers bridging the side walls adjacent one end of the tray and spaced from one another to support a sheet material coil superimposed thereon, a support element bridging the side walls adjacent the other end of the tray and having an upper support surface for sheet material from the coil, a tray bottom of normally planar sheet material, the tray bottom having one edge fixedly secured to the tray beneath the rolls and the remainder of the bottom projecting toward the support element, and retaining means securing the tray bottom free edge to the support at a distance from the one secured bottom edge which is less than the unconfined planar length of the bottom, so that the bottom assumes a curved configuration for guiding the sheet material from the coil to the support element.

2. A coil as defined in claim 1, wherein the support element upper surface is horizontal and merges into a downwardly inclined surface directed toward the coil support rollers, and said retaining means includes an elongated recess in said inclined surface and a downturned flange on the tray bottom free edge, said flange being inserted into said recess to retain the tray bottom in position in its curved configuration.

3. A coil cradle for holding a coil of sheet material so that the material can be unrolled from the coil and cut to length, comprising a pair of side walls and a scoring bed cooperatively defining an open-topped, open-bottomed tray; a pair of horizontal rollers carried by the side walls in spaced relation to the scoring bed and adapted to receive the coil thereon; means for guiding the sheet material withdrawn from the coil onto the upper surface of said scoring bed, said scoring bed having on its upper surface a pair of spaced, raised, non-marring surfaces, said non-marring surfaces contacting the undersurface of the withdrawn material; a moveable scoring guide having a linear edge overlying the withdrawn material and vertically alignable with the space between said non-marring surfaces, said linear edge when so aligned providing a guide for a cutting means utilized to score the withdrawn material, and said hold-down element being moveable away from said scoring bed to accommodate the entry of the withdrawn material therebetween and being moveable toward the scoring bed to clamp the withdrawn material therebetween and to locate said linear edge in alignment with said space.

4. A coil cradle as defined in claim 3, wherein the scoring guide is aluminum and the scoring linear edge of the guide is sheathed in an abrasion resistant covering.

5. A coil cradle as defined in claim 3, wherein said scoring guide bridges the tray sidewalls and is supported for movement relative to the scoring bed by pivot arms carried by the tray side walls and located outside the confines thereof.

6. A coil cradle for holding a coil of sheet material so that the material can be unrolled from the coil and cut to length, comprising a pair of side walls and an end wall cooperatively defining an open-topped tray, first and second freely rotating rolls supported on and bridging the side walls and adapted to support an annular, open-ended coil of sheet material thereon, a pivot arm carried, respectively, by each sidewall, a third roll adapted to be positioned within said coil and projecting therethrough, means detachably securing each pivot arm to the adjacent end of said third roll, and means biasing each of said pivot arms downwardly, so that the third roll is urged into contact with the inner periphery of said coil to hold the coil on said first and second rolls.

7. A coil cradle as defined in claim 6, wherein one of the rolls is mounted on a shaft projecting beyond the side walls and each pivot arm has one end secured to said shaft for free pivotal movement thereon.

8. A coil cradle as defined in claim 6, wherein said third roll has a shaft projecting beyond the side walls and engaged in an open bottomed notch formed in the adjacent pivot arm, said biasing means urging said arms downwardly to retain the roll shaft in said notches.

9. A coil cradle as defined in claim 6, wherein the third roll contacts the interior of the coil in direct opposition to one of the first and second rolls, so that the coil is clamped in position by the force of the biasing means without tending to distort the coil.

* * * * *